US005322229A

United States Patent [19]

Imada

[11] Patent Number: 5,322,229

[45] Date of Patent: Jun. 21, 1994

[54] ELASTIC ROLL FOR APPLYING BACK TENSION

[75] Inventor: Toshio Imada, Tokyo, Japan

[73] Assignee: Sanno Tekko Kabushiki Kaisha, Tokyo, Japan

[21] Appl. No.: 52,297

[22] Filed: Apr. 26, 1993

Related U.S. Application Data

[63] Continuation of Ser. No. 787,946, Nov. 5, 1991, abandoned.

[30] Foreign Application Priority Data

May 23, 1991 [JP] Japan ..... 3-036775[U]

[51] Int. Cl.[5] ..... B65H 35/02; B65H 23/14

[52] U.S. Cl. ..... 242/56.2; 242/75.2; 226/195

[58] Field of Search ..... 242/75.2, 56.9, 56.2; 226/195

[56] References Cited

U.S. PATENT DOCUMENTS

| | | | |
|---|---|---|---|
| 3,111,285 | 11/1963 | Coker et al. | 242/75.2 |
| 3,111,742 | 11/1963 | Lakin | 29/125 |
| 3,386,679 | 6/1968 | Foulon et al. | 226/195 X |
| 3,841,580 | 10/1974 | Rodach | 242/75.2 |
| 3,964,658 | 6/1976 | Edwards | 29/125 |
| 4,347,962 | 9/1982 | Uphues | 242/75.2 X |
| 5,038,469 | 8/1991 | Masuda et al. | 29/125 |

FOREIGN PATENT DOCUMENTS 63-196310 8/1988 Japan .

*Primary Examiner*—John M. Jillions
*Attorney, Agent, or Firm*—Keck, Mahin & Cate

[57] ABSTRACT

There is provided an elastic roll for applying back tension to a parallel-extending strips. The roll has a plurality of thin elastic rings of a rubber-like material fitted over a main shaft. The thin elastic rings are tightened together from both sides and fixed in a unitary form to the main shaft.

3 Claims, 2 Drawing Sheets

ELASTIC ROLL FOR APPLYING BACK TENSION

This is a continuation of application Ser. No. 07/787,946, filed Nov. 5, 1991, now abandoned.

BACKGROUND OF THE INVENTION

The present invention relates in general to an elastic back tension applying roll and, more particularly, to an elastic roll, set on an upstream side of a take-up device, for applying a back tension to a plurality of strips, when one piece of steel plate is slit into a plurality of strips so that the strips are then taken up around the take-up device.

The thickness of the strips obtained by slitting a steel plate on slitter line by a slitting machine is not always constant. Consequently, when such strips are taken up by a single take-up device, the diameters of the coils which are formed with these strips become different, and such differences cause the take-up speed, in other words, take-up tension of the strips to differ, so that the resultant coils become tight or loose. Therefore, as shown in FIG. 6 in a usual case, a steel plate I is slit with a slitter 2 into several strips 3*a*, 3*b*, 3*c* and these strips are then passed through a back tension applying apparatus 4 provided on the upstream side of a take-up device 5 to set the take-up tension of the strips 3*a*, 3*b*, 3*c* as uniform as possible, and these strips are then formed into coils 6 by the take-up device 5.

The conventional back tension applying means as the apparatus 4 has upper and lower elastic rolls which are adapted to send out strips 3*a*, 3*b*, 3*c* therefrom and generate tension between these rolls and a take-up device with a braking force applied to the same rolls. The rolls have a plurality of slits on the entire surface. If a plurality of slits are formed on the elastic rolls over the entire lengths and circumferences thereof as described, the rib portions among these slits are drawn and bent due to the take-up tension of strips contacting the same, and returned to their original condition in the positions away from the contact points owing to the elastic restoring force. Thus, the circumferential length of each roll increases by a length corresponding to the quantity of displacement of the rib portions bent in this manner, so that the difference of take-up tension of each strip due to the difference of take-up diameter can be automatically corrected.

However, when the rolls are rotated at a high speed, the rib portions returning to their original condition bounce to produce vibration and noise due to the vibration. In addition, when the strips are made of a soft material, striped traces formed by such bouncing rib portions remain on the surfaces of the strips.

The inventor of the present invention made, by way of trial, elastic rolls which have constantly spaced grooves of a predetermined depth so that the grooves extend at right angle to the axis of the rolls and in parallel with one another, instead of a plurality of above-mentioned ring-like slits provided on the entire rolling surface of the elastic rolls from one end to the other, and conducted experiments on the products made on experimental basis. As a result, a satisfactory result could be obtained with respect to the offsetting or absorption of errors of the take-up speeds of strips, but the free end portions of the ribs defined by the grooves were deformed to the shape of "elephant's legs" due to the compressive force, which deformed portions swung laterally while the rolls were rotated at a high speed.

Consequently, the side surfaces of a taken up strip were not turned up in a straight form and consequently the turned up surfaces became uneven, with the result that only poor-looking coils could be obtained.

Japanese Utility Model Publication No. 63-196310/1988 (unexamined) discloses a tension roll formed by fitting rings of an unwoven fabric cloth over a shaft, and pressing the rings from both sides thereof so as to combine them unitarily. However, the degree of extensional deformation and restoring deformation of such rings of an unwoven fabric cloth occurring in accordance with the variation of the take-up tension of strips is very low and, therefore, the inventor of the present invention has found that the take-up speed of strips cannot be regulated in accordance with the flexure of the rings of an unwoven fabric cloth.

SUMMARY OF THE INVENTION

An object of the present invention is to provide an improved elastic back tension applying roll.

A further object of the present invention is to provide a new elastic roll which allows automatic regulation of the take-up tension of each strip to a substantially constant level.

Another object of the present invention is to provide a new elastic back tension applying roll which has even side surfaces and has no striped traces on the surface.

According to the present invention, there is provided an elastic roll for applying back tension to a plurality of parallel-extending strips, comprising a plurality of thin elastic rings of a rubber-like material fitted sequentially over a main shaft, said elastic rings of a rubber-like material being tightened together from both sides thereof and fixed unitarily to said main shaft.

In the elastic roll of the present invention, when the elastic rolls thus formed are used with a suitable level of braking force applied to the main shafts in the same manner as in the conventional elastic rolls, a plurality of elastic rings of a rubber-like material contact one strip since the thickness of each of the elastic rings, which constitutes the elastic rolls, is small, and the surface portions of the rings of a rubber-like material are deformed in proportion to the take-up tension of the strips and, consequently, the automatic regulation of the take-up tension of each strip to a substantially constant level is effected. Assuming that any ring gets astride two strips of different take-up tension, the number of such ring is only one. Therefore, the automatic regulation of the take-up tension of the strips carried out by the elastic rings of a rubber-like material is not prevented. Since the elastic rings are pressure-tightened together, they are not swung laterally. Accordingly, the side surfaces of the strips taken up into a roll are even and less undulated than the prior art rolls.

The term "a rubber-like material" is used herein with its generic meaning so that it means and includes a material, such as a synthetic rubber or plastic, which at room temperature can be stretched under stress and, upon immediate release of the stress, will return with force to its approximate original length.

PREFERRED EMBODIMENTS OF THE INVENTION

Figure 1:
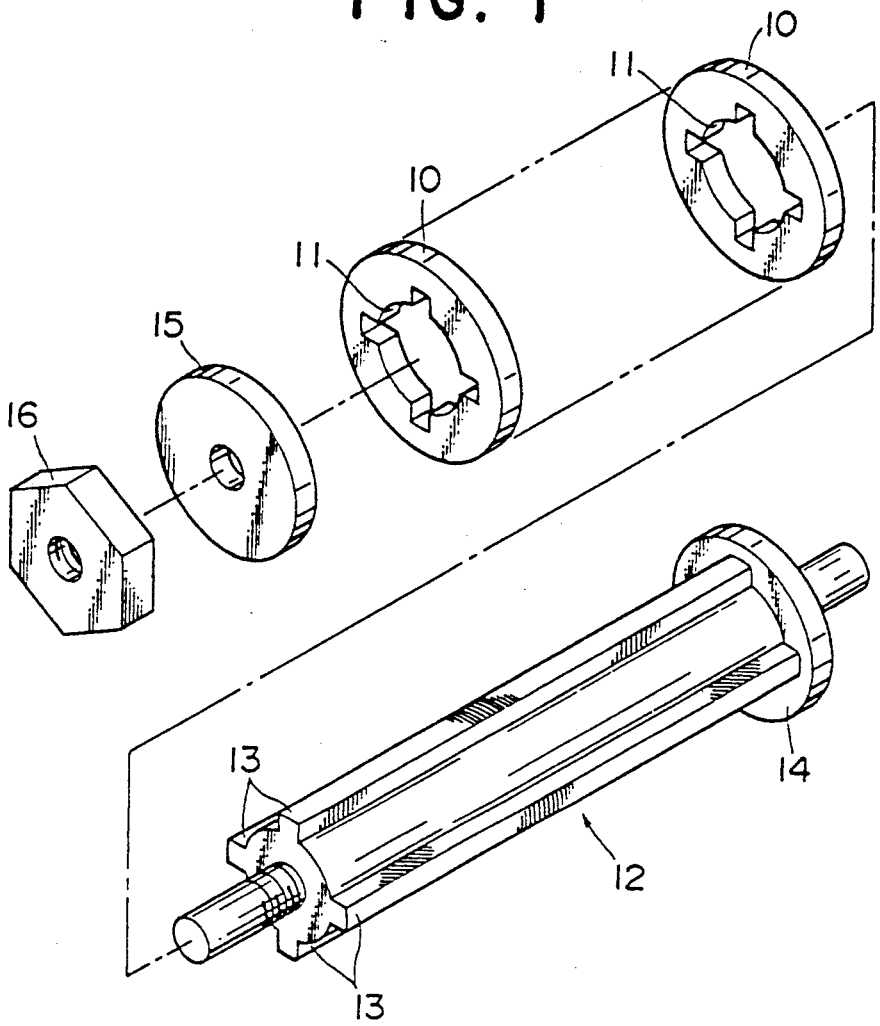
FIG. 1 is an exploded, perspective view of an elastic back tension applying roll according to an embodiment of the present invention.

A preferred embodiment of the present invention will be described with reference to FIG. 1. A plurality of elastic rings 10 made of a rubber or rubber-like material have, for example, an outer diameter of about 400 mm, and a thickness of about 4.0 mm. The ring 10 has a central hole 11, the shape of which is in conformity with the cross sectional shape of a main shaft 12. In the embodiment of FIG. 1, the main shaft 12 has keys or projections 13 on the outer circumference of the main shaft 12. The main shaft 12 may also be formed to, for example, a cross-sectionally square shape, and, in such a case, the central holes 11 in the elastic rings 10 are, of course, made to such a shape as to meet with the shape of the central holes 11. A holding plate 14 is disposed at one end portion of, and integrally with, the main shaft 12 to receive a plurality of elastic rings 10 fitted sequentially over the main shaft 12 from the other end portion thereof along the entire length of the main shaft 12. When all of these elastic rings 10 are fully fitted in this manner, a holding plate 15 is applied to the finally-fitted ring 10 and tightened with a nut 16, so that the elastic rings 10 are pressure-tightened from both sides thereof. The outer diameter of these holding plates 14, 15 is set slightly smaller than that of the elastic rings 10.

Instead of integrally forming the holding plate 14 at one end portion with the main shaft 12, the holding plate 14 may also be formed separately (not shown) from the main shaft 12 as similar as the holding plate 15 at the other end portion thereof, so that the holding plate 14 can be pressed with a nut as the nut 16 from the other side of the main shaft 12.

Figure 2:
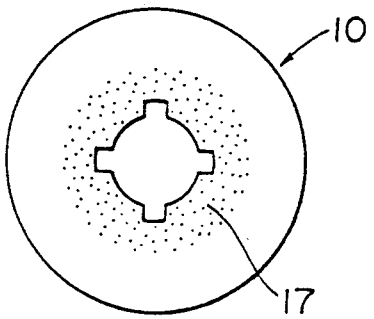
FIG. 2 is a plan view of an elastic ring for formation of the roll shown in FIG. 1 by means of bonding.
Figure 3:
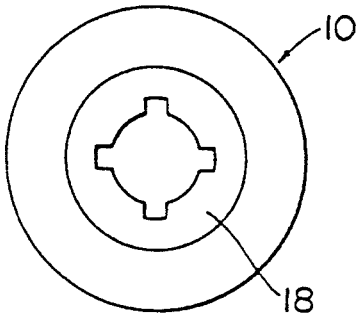
FIG. 3 is a plan view of an elastic ring having an iron core at the center thereof in an embodiment of the invention.

The elastic rings 10 may be bonded to one another at their inner circumferential portions 17 shown by dots in FIG. 2. If the rings 10 are bonded in this manner, the ring-tightening operation is easily carried out. Although more complicated manufacturing process is required, the central portion of each elastic ring 10 may be formed with an iron core 18 as shown in FIG. 3.

Figure 4:
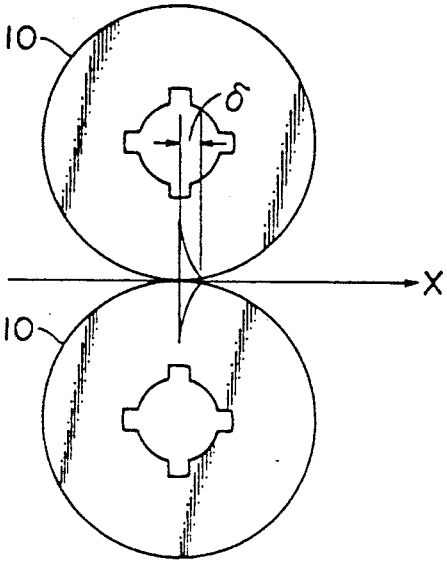
FIG. 4 is a diagram showing an automatic regulating function of a take-up tension of the elastic rings.

In FIG. 4 illustrating the operation of a pair of elastic rings 10, 10 of a rubber-like material, when the take-up tension of strips imparted to the rings 10, 10 in the tangential direction thereof shown by an arrow "X" becomes high, the portions of the elastic rings 10, 10 which are close to the outer surfaces thereof are deformed against the elastic force of the rings 10, 10. A reference character $\delta$ represents the quantity of displacement on each outer surface. When the take-up tension becomes low, the elastic rings 10, 10 return to their original condition owing to their elastic self-restoring force. The elastic rings 10, 10 are thus deformed in proportion to the take-up tension of the strips. Consequently, the automatic regulation is achieved for maintaining the take-up tension of the strips at a substantially constant level.

Figure 5:
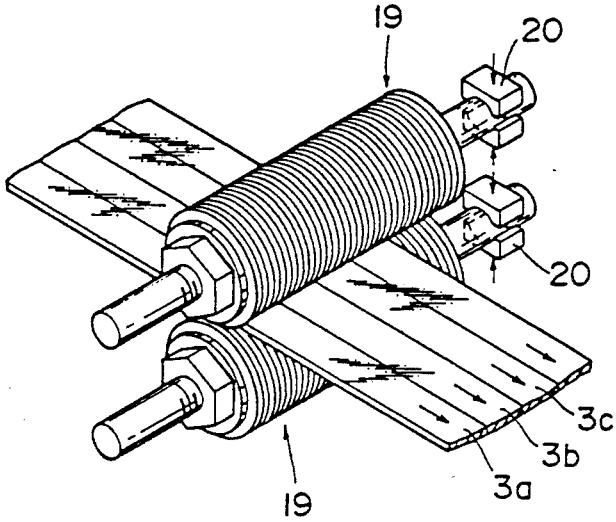
FIG. 5 is a perspective view of the elastic back tension applying rolls in use according to the invention.
Figure 6:
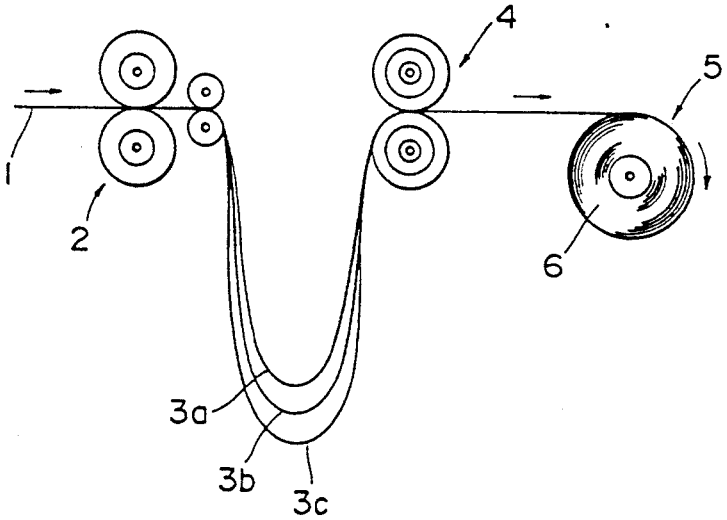
FIG. 6 is a diagram of a slitting machine arranged in a predetermined position for feeding the strips on a production line.

In FIG. 5 showing the condition of use of elastic rolls 19, 19 obtained in the above-mentioned manner, Reference numerals 20, 20 represent brakes for applying a braking force to the elastic rolls 19, 19. Since the thickness of one elastic ring 10 of a rubber-like material is as thin as, for example, around 4 mm, at least two elastic rings 10 are contacted with each of the strips 3*a*, 3*b*, . . . , and each of such elastic rings exhibits its own automatic take-up tension regulating function mentioned above. This automatic take-up tension regulating function is not impeded by one elastic ring 10 rotating in contact with and extending over two adjacent strips such as strips 3*a*, 3*b*.

In the above-described embodiment, the elastic back tension applying rolls are arranged so as to be opposed to each other vertically as shown in FIGS. 4 and 5. In a certain type of strip take-up apparatus, elastic back tension applying rolls are arranged in a horizontally opposed state to pass strips along an S-shaped path. Even with this type of apparatus, the elastic rolls work in the same manner as those described with reference to FIG. 4, and the same automatic regulation of take-up tension of strips is attained.

According to the present invention, a plurality of thin elastic rings of a rubber-like material are pressure-tightened together, and the resultant products are used as elastic back tension applying rolls. Therefore, in spite of such simple structures, displacement proportional to a take-up speed difference is generated on the surface portions, which the strips contact, of the rings of a high elasticity. A difference in the quantities of displacement is generally around 0.5–1.0%, so that an error of tension occurring on the basis thereof is substantially on the same order. Accordingly, the strips are taken up with a substantially uniform tension.

Moreover, since the elastic rings of a rubber-like material are pressed by one another, they are not swung laterally, and the side surfaces of the taken-up strips are wound up evenly and beautifully, so that good-looking wound strips are obtained. Since no portions of the elastic rings bounce and beat the strips during the rotation thereof, unpleasant noise and bouncing of the elastic rings which cause striped traces to occur on the strips are not provided while the elastic rings are rotated at a high speed.

What is claimed is:

1. A combination of a pair of elastic rolls and a take-up device comprising:

a pair of elastic rolls, and a take-up device for strips of a steel plate, wherein said pair of elastic rolls is set on an upstream side of said take-up device, for applying a back tension to a plurality of strips obtained when one piece of steel plate is slit into a plurality of strips wherein said strips pass between said pair of elastic rolls and are then taken up around said take-up device, each said elastic roll comprising a plurality of thin elastic rings of a rubber-like material fitted sequentially over a main shaft, said elastic rings of a rubber-like material being tightened from both sides thereof and fixed unitarily to said main shaft, wherein said rubber-like material is stretchable under stress and, upon immediate release of the stress, returns to its original length, and displacement proportional to a take-up speed difference is generated on a surface of said roll, thereby taking up the strips with a substantially uniform tension.

2. A combination according to claim 1, wherein said main shaft comprises keys extending radially outwardly on an outer circumference thereof, said thin elastic rings each having a central hole in conformity with a shape of said keys of said main shaft.

3. A method of applying back tension to a slit steel plate comprising:

providing a pair of elastic rolls on an upstream side of a take-up device for strips of a steel plate;

slitting a steel plate into a plurality of strips;

passing said strips between said pair of elastic rolls;

taking up said slit strips around said take-up device;

applying a substantially uniform back tension to said plurality of strips;

wherein each said elastic roll comprises a plurality of thin elastic rings of a rubber-like material fitted sequentially over a main shaft, said elastic rings being tightened from both sides thereof and fixed unitarily to said main shaft, said rubber-like material being stretchable under tress and, upon immediate release of the stress, returning to its original length, said method further comprising:

generating displacement proportional to a take-up speed difference on a surface of said rolls, and taking up the strips with a substantially uniform tension.

* * * * *